United States Patent [19]

Bilberg

[11] 4,296,711

[45] Oct. 27, 1981

[54] HEATING BOILER

[75] Inventor: Erik A. Bilberg, Strängnäs, Sweden

[73] Assignee: EABVV Utvecklings Aktiebolag, Strängnäs, Sweden

[21] Appl. No.: 121,659

[22] Filed: Feb. 15, 1980

[30] Foreign Application Priority Data

Apr. 10, 1979 [SE] Sweden ..... 7903172

[51] Int. Cl.[3] ..... F22B 31/04

[52] U.S. Cl. ..... 122/22; 122/2; 122/149

[58] Field of Search ..... 122/2, 149, 22, 7 B

[56] References Cited

U.S. PATENT DOCUMENTS

| | | | |
|---|---|---|---|
| 1,058,190 | 4/1913 | McGinnis | 122/22 |
| 1,690,260 | 11/1928 | Wallis | 122/2 |
| 1,691,462 | 11/1928 | Borge | 122/2 |
| 3,223,074 | 12/1965 | Tanner et al. | 122/2 |
| 3,251,345 | 5/1966 | Brody et al. | 122/2 |
| 3,477,411 | 11/1969 | Gething | 122/149 |
| 4,162,686 | 7/1979 | Infield et al. | 122/22 |
| 4,206,723 | 6/1980 | Kunkel | 122/2 |

FOREIGN PATENT DOCUMENTS

| | | | |
|---|---|---|---|
| 237852 | 1/1965 | Austria | 122/2 |
| 966236 | 8/1964 | United Kingdom | 122/2 |

*Primary Examiner*—Henry C. Yuen

*Attorney, Agent, or Firm*—Murray and Whisenhunt

[57] ABSTRACT

A heating boiler comprises separate furnaces for oil and solid fuel. The oil combustion chamber can be connected directly to flues in contact with water via an afterburning chamber (11) common to the two furnaces. The connection (22) between the oil-combustion chamber (8) and the afterburner chamber can be shut off by a damper (25). Instead a connection is opened between the oil combustion chamber and the furnace (9) for solid fuel via an ash compartment and a grate (20) under the furnace for solid fuel. Through the arrangement with the damper (25) a number of possible variations can be obtained depending on the actual heat requirements.

6 Claims, 1 Drawing Figure

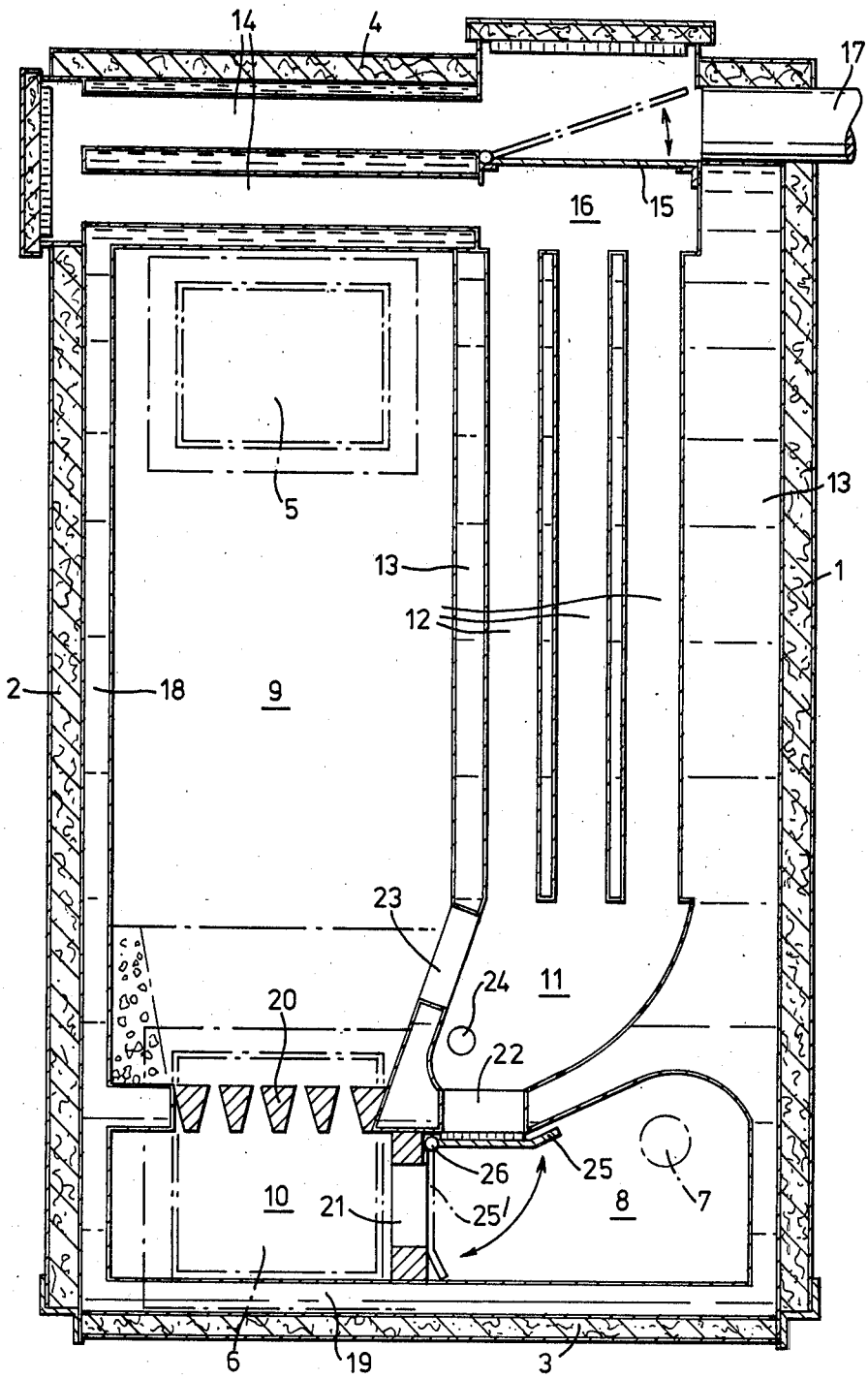
14
4
17
16
15
5
13
13
1
12
2
18
9
23
24
11
20
22
26
25
10
21
25'
8
7
6
19
3

HEATING BOILER

TECHNICAL FIELD

The invention relates to a heating boiler. More specifically, the invention relates to a heating boiler for combined firing with oil/gas or solid fuel, comprising separate furnaces (combustion chambers) for oil/gas or solid fuel and common flues in contact with water for the two furnaces, wherein the heating surfaces of the boiler include said flues in contact with water and at least the walls in contact with water in the furnace for solid fuel.

BACKGROUND ART

So-called universal boilers with common furnaces for solid fuel and for oil-firing are generally known. These boilers are primarily intended for solid fuel, such as coke, but can also be provided with an oil burner at the top. A universal boiler of this type is shown for example in the DE-AS No. 1 102 368. In this known boiler, a damper closes an upper passage between the common furnace (combustion chamber) and the flues of the boiler, when the boiler is fired with oil. In this case, the flue gases enter the flues instead via a passage in the lower portion of the boiler. On the other hand, when the boiler is fired with solid fuel, the upper flue is opened as a result of the fact that the damper is moved up and shields the oil burner. This known boiler has the disadvantage common to all universal boilers with a common furnace that the furnace cannot be made in a manner which is optimum for both firing with solid fuel and for oil firing.

Another limitation is that it is not possible to fire simultaneously with solid fuel and with oil, something which may be desirable when the maximum amount of heat is required. This possibility is offered, on the other hand, with the boiler as shown in FIG. 3 in the Swedish Pat. Spec. No. 94 956. In this boiler, the furnace for solid fuel is formed primarily only with a view to burning rubbish and serious disturbing operation must be expected in the oil burner working in the same combustion chamber, particularly as the flue gases from the rubbish combustion sweep directly past in front of the nozzle of the oil burner. Furthermore, the Swedish Pat. Spec. No. 360 458 shows a heating boiler with separate furnaces for firing with gas and/or oil and for solid fuel. The flame from the gas or oil burner is directed towards a perforated wall in the opposite end of the furnace, behind which there may be solid fuel. The hot flue gases from the gas or oil burner do not, however, pass through the perforated wall into the furnace for the solid fuel whether when firing is taking place in this furnace or when only the gas or oil firing is being used. Instead, the flue gases from the furnace (combustion chamber) of the gas/oil burner are always taken off directly upon into a heat-exchange chamber through a pair of flues in the roof of the combustion chamber. The aim of the arrangement is that with a high-speed supply of fuel the flue gases should pass up through both flues but with a low speed supply of fuel they should only pass through the one flue. The possibility of improving the heat economy which this self-regulation can afford is, however, very moderate and the possibilities for a satisfactory heat economy which a suitably formed furnace for solid fuel can give have not been utilized at all. In consequence all possibilities of leading the flue gases from the gas/oil burner into the furnace for the solid fuel have also been completely ignored, something which often happens in boiler constructions with separate furnaces for oil or gas and for solid fuel. Among such known constructions, a heating boiler manufactured by the Swedish Company Exoverken AB under the name "Exo oljepanna typ G och H" may be mentioned for example. On the other hand, this lacks a possibility which the boiler according to the Swedish Pat. Spec. No. 360 458 affords, namely of leading the flue gases from the combustion chamber of the oil burner directly up into a heat-exchange chamber, that is to say up into a system of flues in contact with water, without passing through the furnace for solid fuel, which may be desirable with a low heat requirement.

DISCLOSURE OF INVENTION

One object of the invention is to eliminate the above-mentioned disadvantages and limitations in the previously known heating boilers. More specifically, it is an object of the invention to offer a heating boiler which can be fired equally well with solid fuel such as wood, coke and waste, as with "fluid" fuels such as gas and oil, and also with solid fuels with a very small particle size such as sawdust. One object is to be able to fire with sawdust in the furnace for solid fuel without appreciable slag formation or caking. Furthermore it is an object of the invention to offer a heating boiler the heat generation of which can be adapted with very great accuracy to the actual heat requirements in various circumstances and because of different seasons and/or varying consumption of hot water, so that a high degree of efficiency can always be achieved without problems arising for this reason with damage as a result of precipitated condensate. A further object is to offer a boiler with a very large effective heating surface despite small external dimensions, that is to say with a highly effective area/volume relationship.

These and other objects can be achieved in that the furnace for firing with oil or gas on the one hand is adapted to be able to be connected directly to the common flues in contact with water for the two furnaces, a connection between said first furnace and said flues being open and a connection between said first furnace for firing with oil or gas and said other furnace for solid fuel being closed, on the other hand is adapted to be able to be series coupled with said other furnace the first-mentioned direct connection with the flues being closed and the last-mentioned connection to the furnace for solid fuel being open.

The furnace for firing with oil or gas may appropriately be adapted to be able to be connected to the furnace for solid fuel via a grate in the latter furnace, and a damper may appropriately be provided so as to be able to close and open alternately the connections between the furnace for oil/gas and said flues or between the furnace for oil/gas and the furnace for solid fuel.

According to one form of embodiment, the furnace for solid fuel is of the under combustion type with supply of secondary air in an after-burning chamber common to the two furnaces. In order to achieve a maximum effect, a filter may also be provided for the flue gases in the afterburning chamber. This filter is made of a heat-resisting metallic or ceramic material, and the filter on the one hand serves to collect up certain incompletely burnt products, such as soot, and on the other hand acts as an igniter for the incompletely burnt products which are collected in or pass through the filter in the afterburning chamber common to the two separate furnaces.

Further features of the heating boiler according to the invention will be apparent from the following description of a preferred form of embodiment.

BRIEF DESCRIPTION OF THE FIGURE

The FIGURE of the drawing shows a vertical section through the heating boiler according to a preferred form of embodiment. The section is taken parallel to the front and the back walls.

BEST MODE OF CARRYING OUT THE INVENTION

The heating boiler illustrated in the FIGURE is bounded by the insulating side walls 1 and 2, the insulated bottom 3 and the roof 4 and the back wall and the front which are not shown. In the latter there is a charging aperture 5 for solid fuel, a soot aperture 6 and an oil burner unit with an oil burner 7. The parts 5–7 are indicated by broken lines in the FIGURE.

The heating boiler contains two separate furnaces, namely an oil combustion chamber 8 and a furnace 9 for solid fuel. An ash compartment is designated by 10 while an afterburning chamber is designated by 11. Extending from the afterburning chamber 11 in a manner which is known per se from the Swedish Pat. Spec. No. 360 458 are a group of vertical flues 12 up through a water store 13. Furthermore there is a group of horizontal flues 14 above the furnace 9 for solid fuel. Disposed between the two groups of flues 12 and 14 in contact with water is a damper 15 in a space 16 in a manner which is known per se from the Swedish Pat. Spec. No. 388 267. The damper 15 can also be removed to facilitate soot removal work. When the damper 15 is moved upwards, the flue gases from the vertical flues 12 can pass in a manner which is known from said Swedish Pat. Spec. No. 388 267 directly out through a waste-gas pipe 17 and when the damper 15 is moved down the flue gases are forced to pass through the horizontal flues 14 as a result of which the heat-exchange surface is increased. Both the oil combustion chamber 8 and the furnace 9 for solid fuel as well as the ash compartment 10 have water-conveying walls or bottom. More specifically, the return pipes 18 for water are disposed in one wall of the furnace 9 for solid fuel. The return pipes lead into the bottom portion 19 of the boiler under the ash compartment 10 and the oil combustion chamber 8. A grate under the furnace 9 for solid fuel is designated by 20. A connection between the oil combustion chamber 8 and the ash compartment 10 has been designated by 21, a connection between the oil combustion chamber 8 and the afterburning chamber 11 has been designated by 22, and a connection between the furnace for solid fuel 9 and the afterburning chamber 11 has been designated by 23. A supply pipe 24 for secondary air leads into the afterburning chamber 11.

According to the invention, a damper 25 is adapted for swinging about a joint 26. By means of a control at the front of the boiler, the damper 25 can be swung about the joint 26 between the horizontal position shown in the FIGURE where the damper 25 closes the connection 22 to the afterburning chamber 11, and a vertical position 25' in which the damper closes the connection 21 to the ash compartment 10 and hence further to the furnace 9 for solid fuel via the grate 20. In the boiler described above the effective heating surface can be varied within wide limits. On the one hand there is the possibility of using only one of the two furnaces 8 and 9 or of using both furnaces. On the other hand there is the possibility of varying the effective heating surface within wide limits with the two dampers 25 and 15. With the greatest heat requirement, it is thus possible to fire with both oil burners 7 in the oil combustion chamber 8 and with solid fuel in the furnace 9. In this case, the damper 25 is preferably moved up into the horizontal position so that the connection 22 between the oil combustion chamber 8 and the afterburning chamber 11 is closed. Furthermore, the damper 15 can be regulated so that the horizontal flues 14 are also used. The hot gases from the oil combustion chamber 8 pass via the grate 20 up into the furnace 9 for solid fuel together with primary air through the ash aperture 6 and possibly excess air from the oil combustion chamber. In the furnace 9 for solid fuel there is a transfer of heat to the walls of the furnace in contact with water. Unburnt products which pass through the pipe 23 are burnt in the afterburning chamber 11, and secondary air is supplied through the pipe 24. A filter of refractory material heated up to the ignition temperature for the unburnt products may be disposed in the afterburning chamber 11, as a result of which an extra contribution of heat is obtained in a manner known per se.

According to an alternative method of using the heating boiler with a low heat requirement, only the oil burner 7 is used. In this case, the damper 25 can be moved down into the vertical position. The flue gases thus pass directly up into the afterburning chamber 11 through the passage 22 and then again up through the vertical pipes 12. As a result of the fact that the furnace 9 for solid fuel is by-passed in this manner, the heating surface utilized is thus reduced, a possibility which is of importance with a low heat requirement. At the same time, the heating surface can also be regulated by means of the damper 15.

Yet another method of utilizing the boiler is to fire with solid fuel in the furnace 9 provided for this. According to the invention, material which otherwise cakes like sawdust can be used in this case. In this case the fan of the oil burner is used. The damper 25 is moved up into the horizontal position so that the air from the oil burner fan (the oil burner is disconnected) flows through the connection 21 and up through the grate 20 so that a necessary draught is obtained in the sawdust on the grate.

Combinations of the above-mentioned methods of operating the heating boiler according to the invention are also conceivable, the method of working in each individual case being adapted on the one hand to the actual heat requirements and on the other hand to the required temperature in the outgoing flue gases, as well as to the available fuels.

It is thus possible always to obtain a high degree of efficiency regardless of the heat requirements. A contributory factor to the high degree of efficiency is the fact that the return pipe 18 is arranged so that it ends under the oil combustion chamber after having passed the furnace 9 for solid fuel.

I claim:

1. In a heating boiler for combined firing with liquid fuel and/or solid fuel, comprising a liquid fuel combustion chamber, a solid fuel combustion chamber having a grate, at least one flue in communication with said chambers and in contact with water, and at least the walls of the solid fuel combustion chamber in contact with water, the improvement comprising a first connection between said liquid fuel combustion chamber and said flue, a second connection between said liquid fuel combustion chamber and said solid fuel combustion chamber, closure means for closing said first connection while opening said second connection to couple said combustion chambers in series through said grate, and for closing said second connection while opening said first connection, whereby the available fuels can be adapted to the heat requirements of said boiler.

2. Boiler of claim 1, wherein said closure means is a damper.

3. Boiler of claim 1 or claim 2, wherein said boiler further includes an afterburner chamber communicating with said chambers, said solid fuel combustion chamber is of the under combustion type, and further including secondary air feed means for feeding secondary air to said afterburner chamber.

4. Boiler of claim 3, wherein said afterburner chamber is located between said liquid fuel combustion chamber and said flue, and said first connection is connected to said afterburner chamber to provide gaseous communication between said liquid fuel combustion chamber and said afterburner chamber.

5. Boiler of claim 4, wherein said liquid fuel is oil or gas.

6. Boiler of claim 4, wherein a plurality of flues are in gaseous communication with said chambers during at least a portion of the time said boiler is in operation.

* * * * *